US008857427B2

(12) United States Patent
Shiue

(10) Patent No.: US 8,857,427 B2
(45) Date of Patent: Oct. 14, 2014

(54) SNORKEL AND MOUTHPIECE ASSEMBLY THEREOF

(75) Inventor: Chih-Cheng Shiue, Taipei (TW)

(73) Assignee: QBAS Co., Ltd (TW)

( * ) Notice: Subject to any disclaimer, the term of this patent is extended or adjusted under 35 U.S.C. 154(b) by 450 days.

(21) Appl. No.: 13/305,994

(22) Filed: Nov. 29, 2011

(65) Prior Publication Data

US 2012/0247459 A1 Oct. 4, 2012

(30) Foreign Application Priority Data

Apr. 1, 2011 (TW) ..... 100111545 A

(51) Int. Cl.

| | |
|---|---|
| ***B63C 11/16*** | (2006.01) |
| ***B63C 11/02*** | (2006.01) |
| ***G10K 5/00*** | (2006.01) |
| ***A62B 9/06*** | (2006.01) |

(52) U.S. Cl.

CPC .. *A62B 9/06* (2013.01); *B63C 11/16* (2013.01)
USPC ..... 128/201.11; 128/201.27; 446/204; 446/216; 116/137 R

(58) Field of Classification Search

CPC ..... A61M 16/0051; A61M 16/049; A62B 9/006; A62B 9/06; A63H 5/00; B63C 9/0005; B63C 11/16; B63C 11/186; B63C 11/205; B63C 11/207; B63C 11/26; G10K 5/00; G10K 5/02
USPC ..... 128/201.11, 202.13–202.16, 848, 128/859–863; 116/2, 108, 137 R–137 A; 446/204, 216
See application file for complete search history.

(56) References Cited

U.S. PATENT DOCUMENTS

| | | | | |
|---|---|---|---|---|
| 4,380,232 | A * | 4/1983 | Doyle | 128/201.11 |
| 7,191,779 | B2 * | 3/2007 | Shiue | 128/201.11 |
| 8,162,709 | B2 * | 4/2012 | Boyer et al. | 440/102 |
| 2003/0075173 | A1 * | 4/2003 | Shahaf | 128/201.25 |

FOREIGN PATENT DOCUMENTS

TW M272744 U 8/2005

OTHER PUBLICATIONS

Office Action for Taiwanese Application No. 10220273090, issued on Mar. 7, 2013, with partial English translation.

* cited by examiner

*Primary Examiner* — Valerie L Skorupa
(74) *Attorney, Agent, or Firm* — Cantor Colburn LLP

(57) ABSTRACT

A snorkel and a mouthpiece assembly of the snorkel are disclosed, in which the mouthpiece assembly includes a main body, a mouthpiece and a whistle. The mouthpiece is connected to the main body; and the whistle has a pivoting portion and a blowing portion opposite to the pivoting portion, in which the pivoting portion is pivotally connected to the main body. The snorkel further includes a tube connected to the main body and communicating with the mouthpiece. In this way, the user can rotate the whistle against the main body for making the whistle face the mouth of the user, instead of greatly rotating the mouthpiece assembly against the tube.

16 Claims, 12 Drawing Sheets

SNORKEL AND MOUTHPIECE ASSEMBLY THEREOF

CROSS-REFERENCES TO RELATED APPLICATIONS

This application claims priority to a Taiwan Patent Application No. 100111545 filed on Apr. 1, 2011.

BACKGROUND OF THE INVENTION

1. Field of the Invention

The present invention relates to a snorkel and a mouthpiece assembly of the snorkel, and more particularly, to a snorkel comprising a whistle and a mouthpiece assembly of the snorkel.

2. Descriptions of the Related Art

When participating in aquatic, underwater or snorkeling sports, people need to wear a snorkel so that they can still breathe the air over the water surface even when their heads are under the water. However, during these water activities, there may be emergency situations in which the person may need to call for help. To this end, a snorkel with a whistle has been proposed, for example, in U.S. Pat. No. 7,191,779 and Taiwan Patent No. TW M272744. Thereby, when the user of the snorkel encounters a danger, he or she can whistle to make a large sound for the purpose of giving an alert.

However, this kind of snorkel still has some shortcomings. In detail, with reference to FIG. 1A, there is a schematic view of a snorkel having a whistle. The snorkel 9 comprises a mouthpiece assembly 91 and a tube 92. The mouthpiece assembly 91 has a mouthpiece 911 and a whistle 912, which are located at two opposite sides of the mouthpiece assembly 91 respectively.

Generally, the mouthpiece 911 of the mouthpiece assembly 91 faces toward the user's mouth and is adapted to be bitten by the user for air exchange. In reference to FIG. 1B, when encountering a danger, the user must rotate the mouthpiece assembly 91 by about 180 degrees relative to the tube 92 to make the whistle 912 face toward the user's mouth before he can use the whistle 912. Because the mouthpiece assembly 91 and the tube 92 are assembled with each other tightly (to prevent water penetration), it is difficult to rotate them relative to each other and, consequently, the user must make great efforts to rotate them. In other words, it is substantially inconvenient for the user to rotate the mouthpiece assembly 91 to a great extent to make the whistle 912 close to the user's mouth.

Further, when the user swims, the exposed whistle 912 is subject to large water resistance, which may cause the mouthpiece assembly 91 to shake. To prevent the shaking of the mouthpiece assembly 91, the user needs to bite the mouthpiece 911 harder, which may cause user's jaw fatigue.

In view of this, an urgent need exists in the art to provide a snorkel and a mouthpiece assembly of the snorkel which can overcome at least one of the aforesaid shortcomings.

SUMMARY OF THE INVENTION

The primary objective of the present invention is to provide a snorkel and a mouthpiece assembly thereof which allow for using a whistle conveniently.

To achieve the aforesaid objective, the snorkel disclosed by the present invention comprises a mouthpiece assembly and a tube. The mouthpiece assembly comprises the following: a main body; a mouthpiece connected to the main body; and a whistle, having a pivoting portion and a blowing portion opposite to the pivoting portion. The pivoting portion pivotally connects to the main body. The whistle is rotatable against the main body from a first position to a second position by means of the pivoting portion; and the blowing portion is closer to the main body when the whistle is at the first position than when the whistle is at the second position. The tube connects to the main body, and communicates with the mouthpiece.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1A:
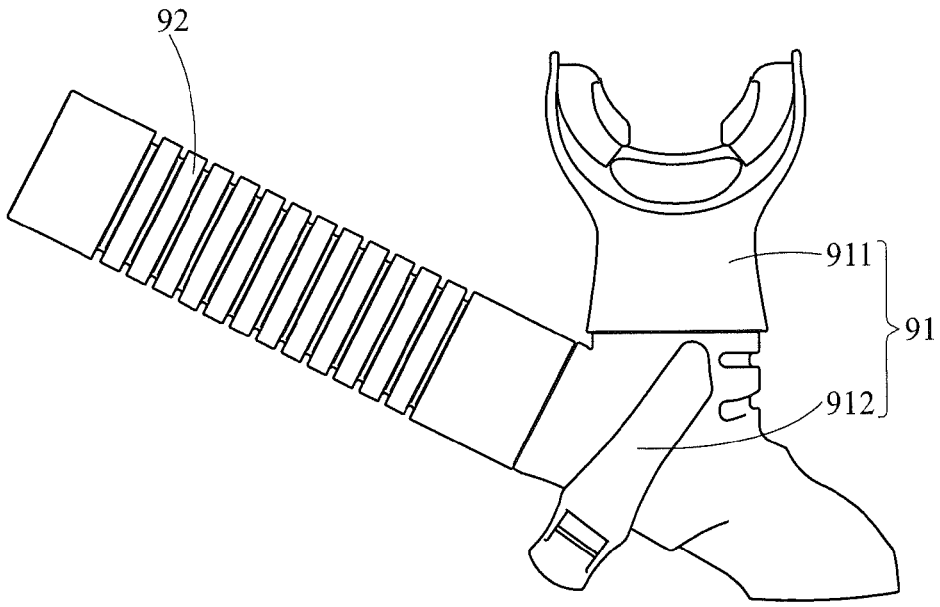
FIG. 1A (Prior Art)
FIG. 1A and FIG. 1B are schematic perspective views of a conventional snorkel.
Figure 1B:
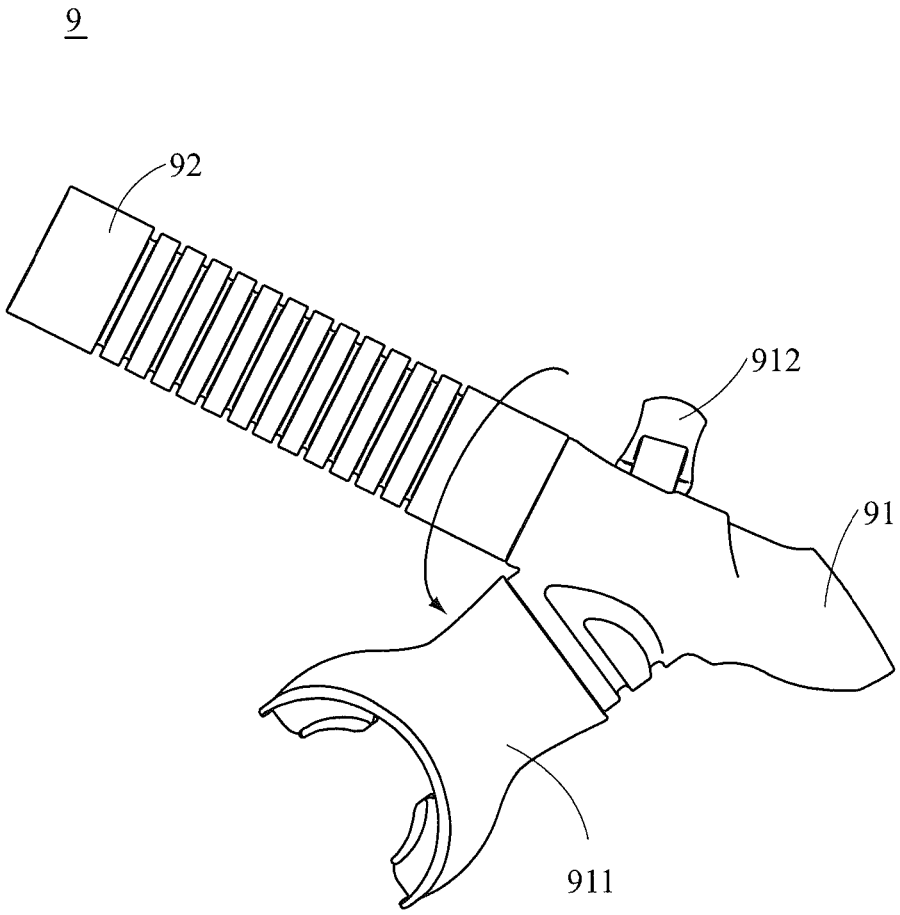
FIG. 1B (Prior Art)
Figure 2A:
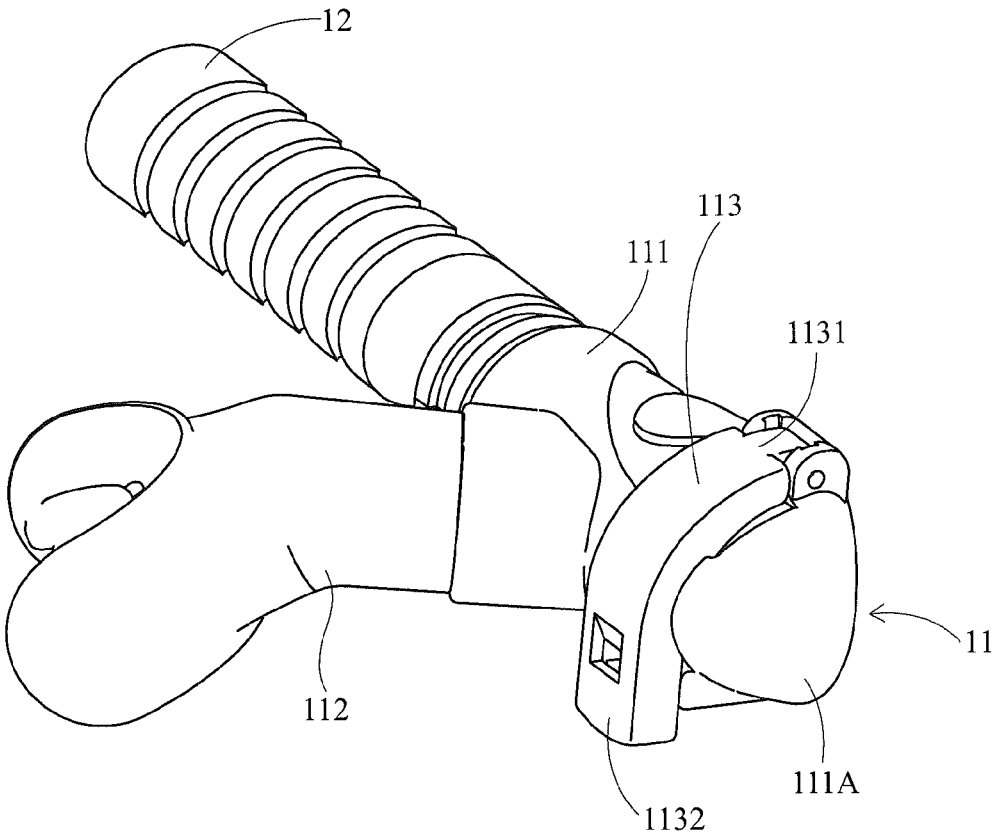
FIG. 2A and FIG. 2B are schematic perspective views of the first preferred embodiment of a snorkel according to the present invention.
Figure 2B:
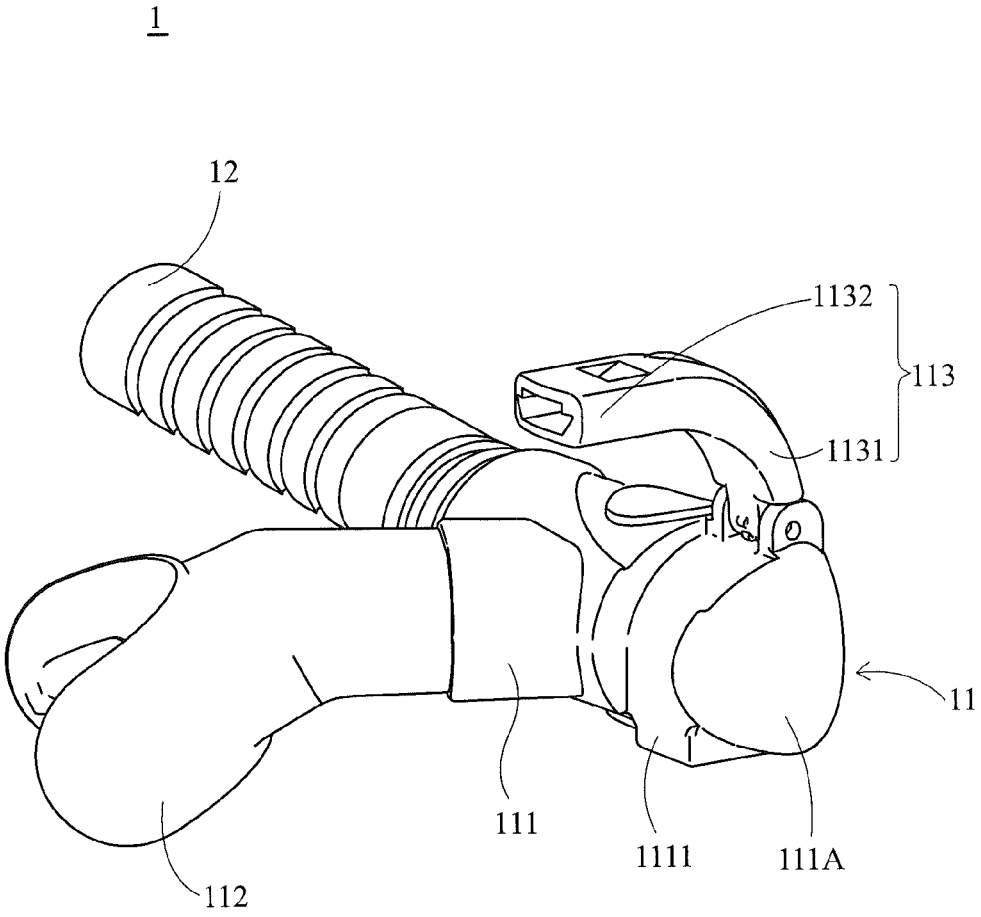

Referring to FIG. 2A and FIG. 2B, there are shown schematic views of a first preferred embodiment of a snorkel according to the present invention respectively. The snorkel 1 comprises a mouthpiece assembly 11 and a tube 12, which will be sequentially described as follows.

The mouthpiece assembly 11 comprises a main body 111, a mouthpiece 112 and a whistle 113. The main body 111 is of a hollow structure, and may be made of a soft material or a hard material. The mouthpiece 112 connects to the main body 111, and communicates with the interior of the main body 111. The mouthpiece 112 and the main body 111 may be formed integrally, or may be manufactured separately and then assembled together.

The whistle 113 has a pivoting portion 1131 and a blowing portion 1132. The pivoting portion 1131 pivotally connects to the main body 111 so that the whole whistle 113 can rotate relative to the main body 111 and the mouthpiece 112. The connection that can be rotated may be achieved in various ways; and in this embodiment, it is achieved in the following way (the present invention is not limited thereto): the pivoting portion 1131 is formed with a circular hole, and the main body 111 is formed with a round shaft which is adapted to be inserted into the circular hole. Additionally, the pivoting portion 1131 and the main body 111 can be assembled with each other in the form of a clearance fit or transition fit so that they can easily rotate relative to each other.

The blowing portion 1132 of the whistle 113 is opposite to the pivoting portion 1131, and is adapted to be held by the user in his/her mouth for blowing to make a sound. The detailed construction of the blowing portion 1132 can be readily understood by those of ordinary skill in the art and is not a concern in this embodiment, so it will not be further described herein. In other words, this embodiment has no limitation on the detailed implementation of the blowing portion 1132 of the whistle 113.

When the user applies a torque to the whistle 113, the whistle 113 can rotate against the main body 111 (and the mouthpiece 112) from a first position to a second position by means of the pivoting portion 1131. When the whistle 113 is at the first position as shown in FIG. 2A, the blowing portion 1132 of the whistle 113 is closer to the main body 111 and may abut on an outer surface 111A of the main body 111 or keep a small distance (not shown) from the outer surface 111A of the main body 111. Furthermore, the outer surface 111A of the main body 111 may be provided with an accommodating groove 1111 so that, when the whistle 113 is at the first position, the blowing portion 1132 of the whistle 113 can be located in the accommodating groove 1111 to reduce an amount of the whistle 113 protruding from the main body 111.

When the whistle 113 is at the second position as shown in FIG. 2B, the blowing portion 1132 of the whistle 113 is farther away from the main body 111. In other words, the blowing portion 1132 of the whistle 113 is closer to the main body 111 when the whistle 113 is at the first position than when the whistle 113 is at the second position. Furthermore, when the whistle 113 is at the second position, the blowing portion 1132 of the whistle 113 and the mouthpiece 112 face the same direction; that is, if the mouthpiece 112 faces toward the user's mouth, the blowing portion 1132 also faces the user's mouth.

The tube 12 is connected to the main body 111 of the mouthpiece assembly 11, and communicates with the mouthpiece 112. That is, air inhaled into the tube 12 can flow into the mouthpiece 112 via the main body 111, and air exhaled into the mouthpiece 112 can flow into the tube 12 via the main body 111.

With the components of the snorkel 1 having been described above, the method for using the snorkel 1 will be described next.

In normal conditions (i.e., conditions without danger), the user can bite the mouthpiece 112 for air exchange and, in this case, the whistle 113 is at the first position. When encountering danger, the user can rotate the whistle 113 to the second position to make the blowing portion 1132 face his mouth and then bite the blowing portion 1132 to make a sound without having to rotate the whole mouthpiece assembly 11 by about 180 degrees against the tube 12 as in the prior art.

Figure 3A:
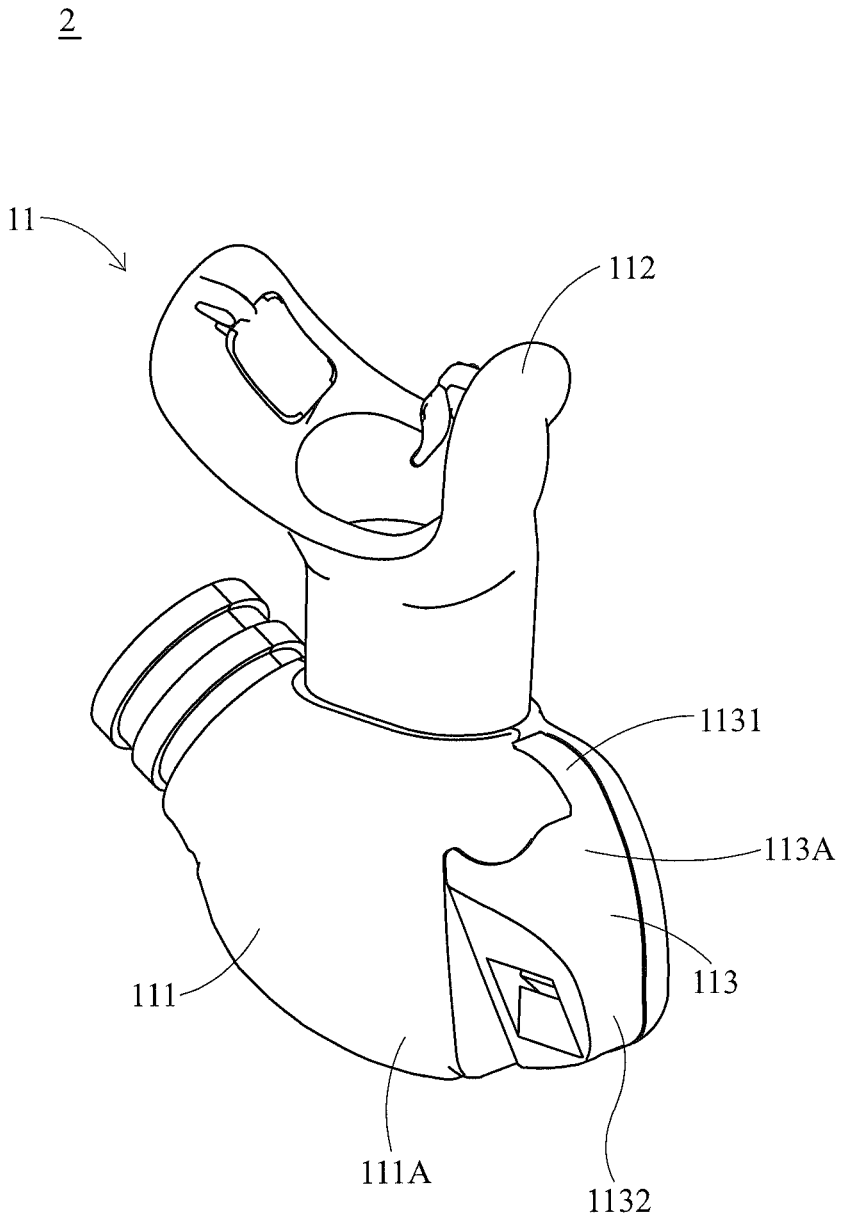
FIG. 3A and FIG. 3B are schematic perspective views of the second preferred embodiment of the snorkel according to the present invention (with a tube being omitted)
Figure 3B:
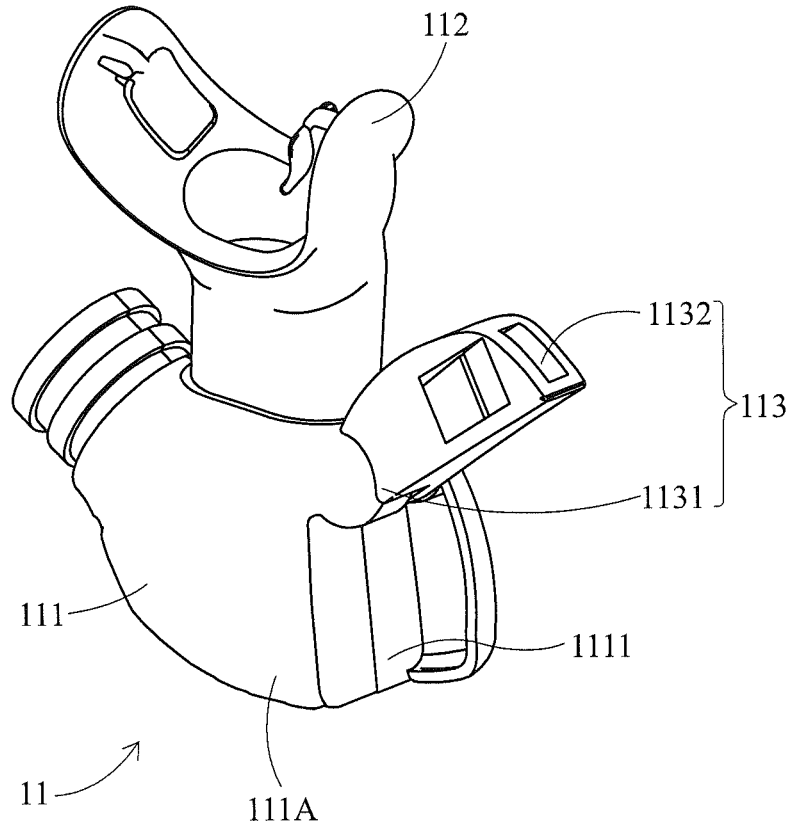

Referring to FIG. 3A and FIG. 3B, there are shown schematic views of the second preferred embodiment of the snorkel according to the present invention respectively. The snorkel 2 of the second embodiment differs from the snorkel 1 of the first embodiment in that: an outer surface 113A of the whistle 113 and the outer surface 111A of the main body 111 of the snorkel 2 are both curved surfaces; and when the whistle 113 is at the first position as shown in FIG. 3A, the outer surface 113A of the whistle 113 and the outer surface 111A of the main body 111 have a smooth transition therebetween. In this way, the whistle 113 and the main body 111 appear to be integrally formed, making it more aesthetically pleasing; and when liquid flows through the juncture between the whistle 113 and the main body 111, disturbance rarely appears.

The snorkel 2 is similar to the snorkel 1 in other aspects; for example, when the whistle 113 is at the second position as shown in FIG. 3B, the blowing portion 1132 of the whistle 113 and the mouthpiece 112 face the same direction. Thus, similarities therebetween will not be further described herein.

Figure 4A:
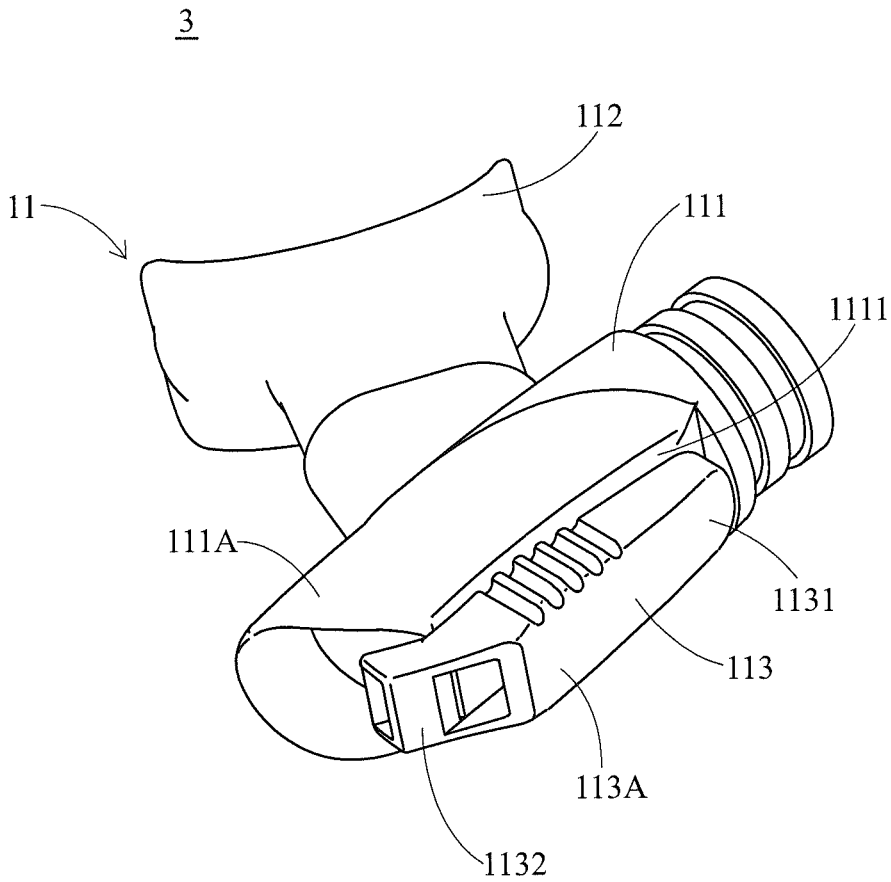
FIG. 4A to FIG. 4C are schematic perspective views of the third preferred embodiment of the snorkel according to the present invention (with the tube being omitted)
Figure 4B:
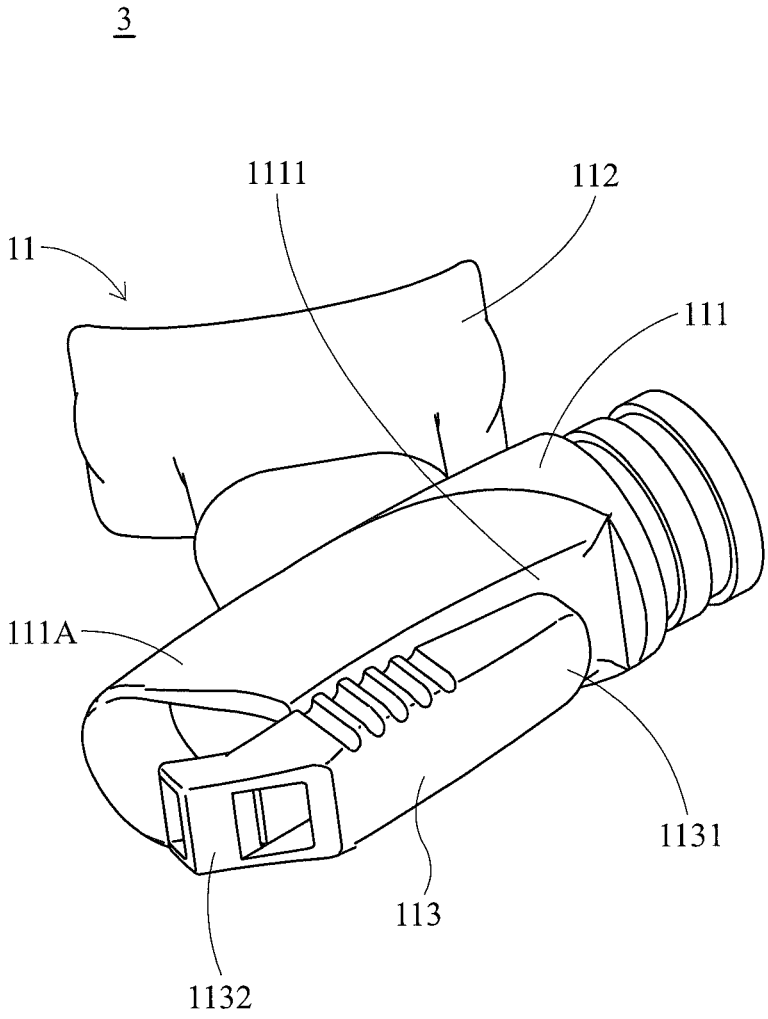
Figure 4C:
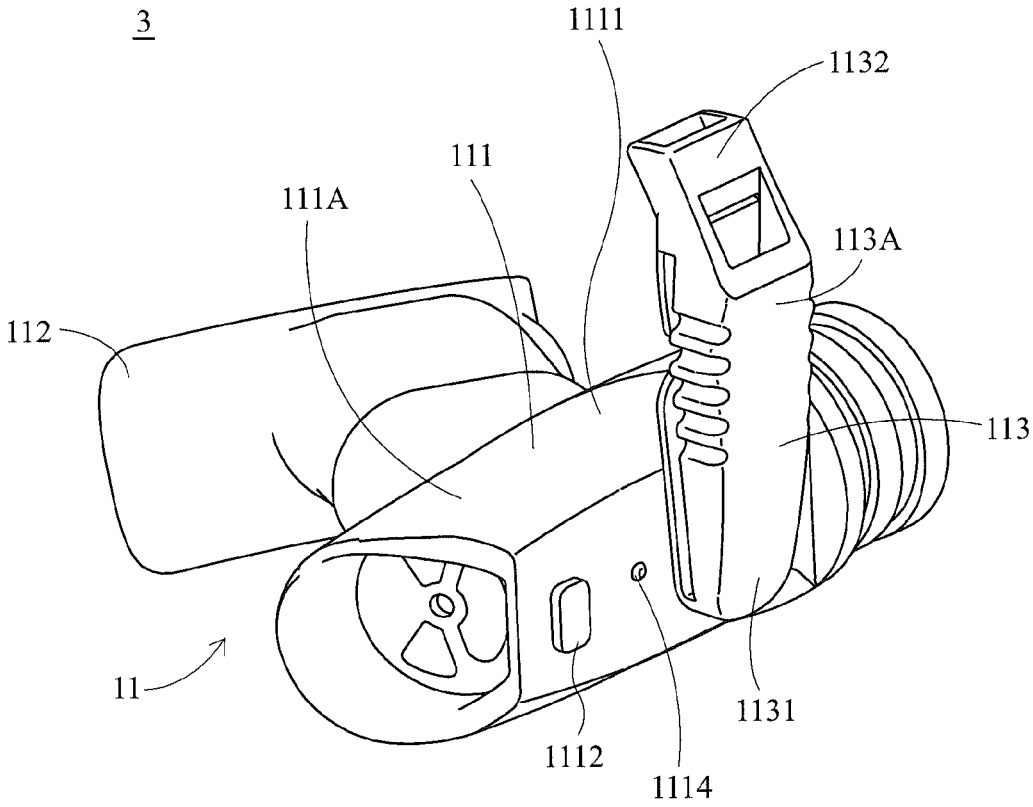

Referring to FIG. 4A to FIG. 4C, there are shown schematic views of the third preferred embodiment of the snorkel according to the present invention. The snorkel 3 of the third preferred embodiment differs from the snorkels 1 and 2 in that: the pivoting portion 1131 of the whistle 113 of the snorkel 3 is rotatably and slidably connected to the main body 111, and the whistle 113 and the mouthpiece 112 are located at different sides of the main body 111.

Furthermore, the user can apply a force to the whistle 113 so that the whistle 113 can slide against the main body 111 from the third position (as shown in FIG. 4A) to the first position (as shown in FIG. 4B); and only after the whistle 113 is located at the first position, can the user rotate the whistle 113 from the first position to the second position (as shown in FIG. 4C). In other words, at the third position, the whistle 113 is unable to rotate against the main body 111. This can ensure that the whistle 113 will not rotate arbitrarily when being impacted by the liquid in the water.

The aforesaid special connection between the pivoting portion 1131 and the main body 111 can be achieved in various ways and, in this embodiment, is achieved in the following way.

Figure 5A:
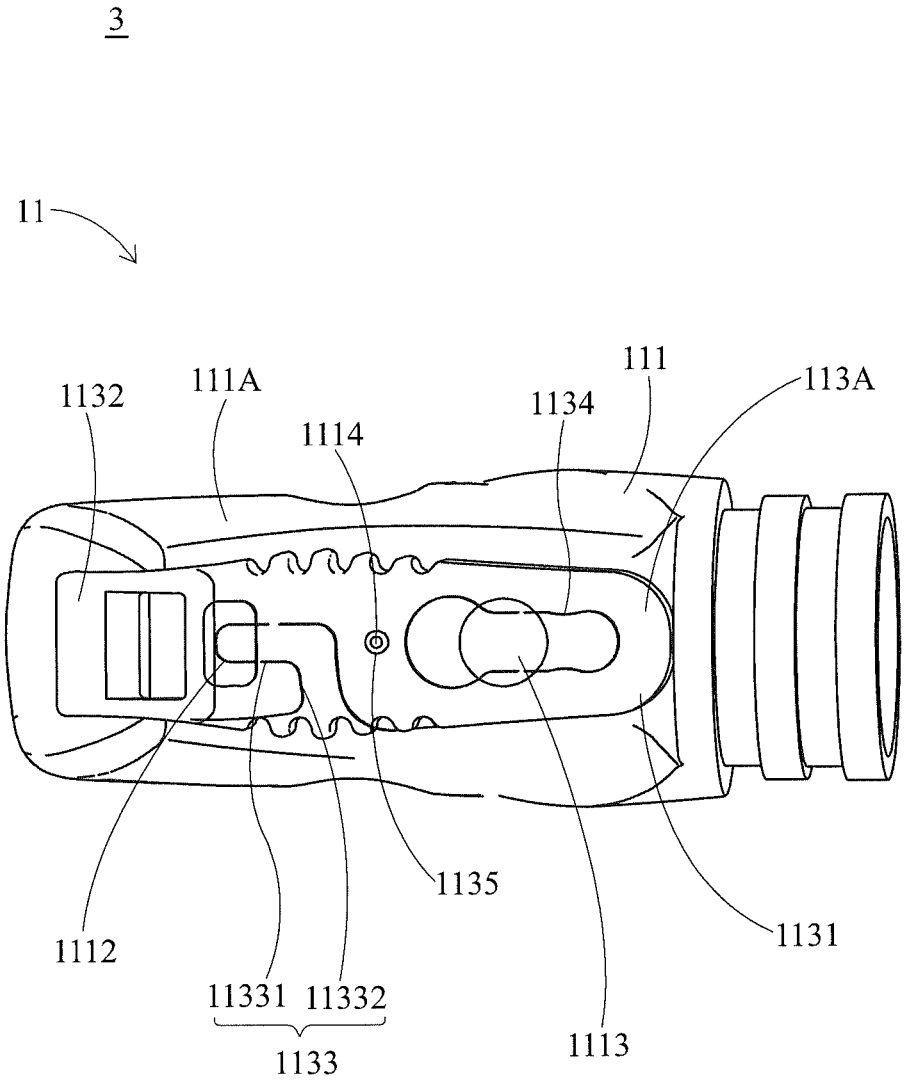
FIG. 5A to FIG. 5C are schematic plan views of the third preferred embodiment of the snorkel according to the present invention (with the tube being omitted).
Figure 5B:
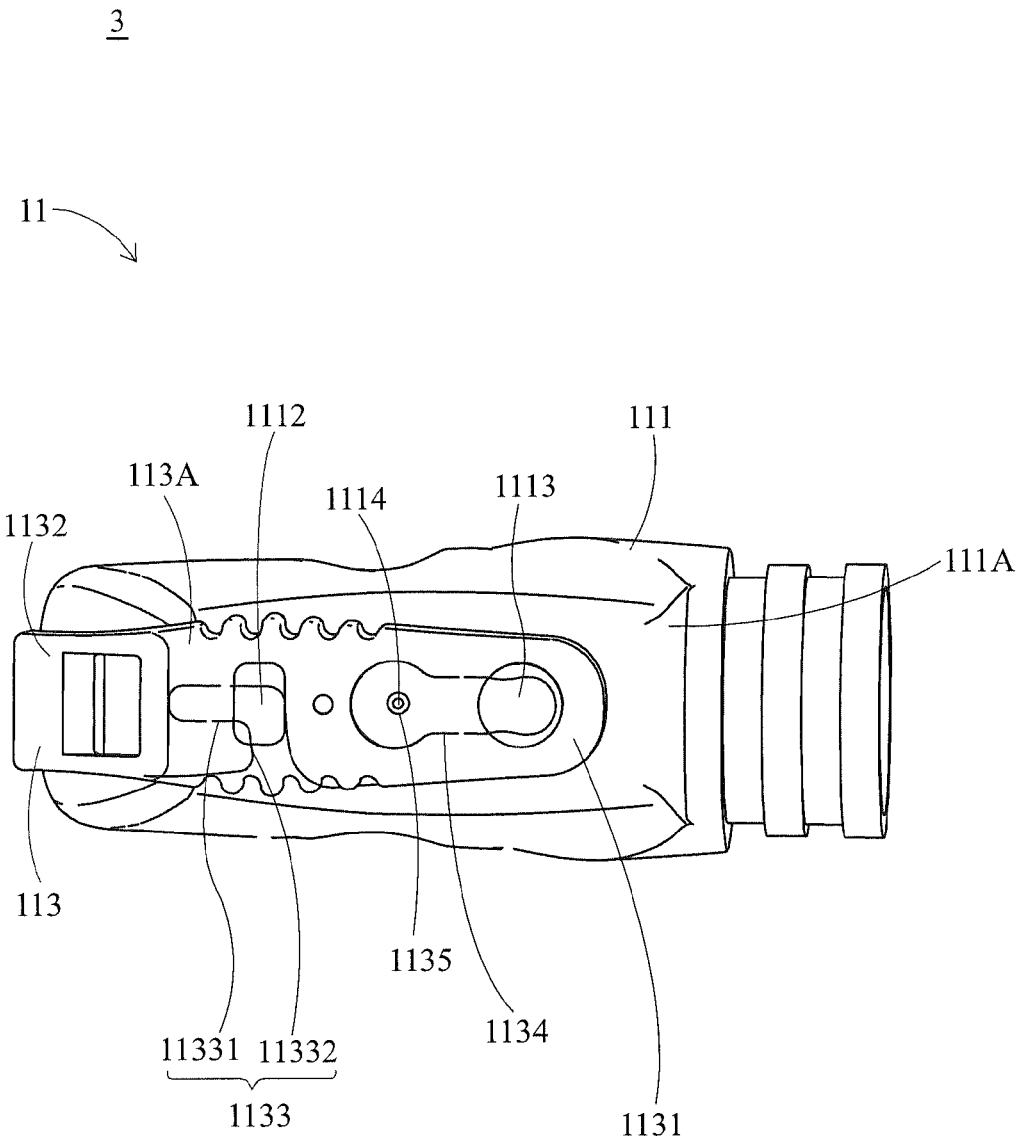
Figure 5C:
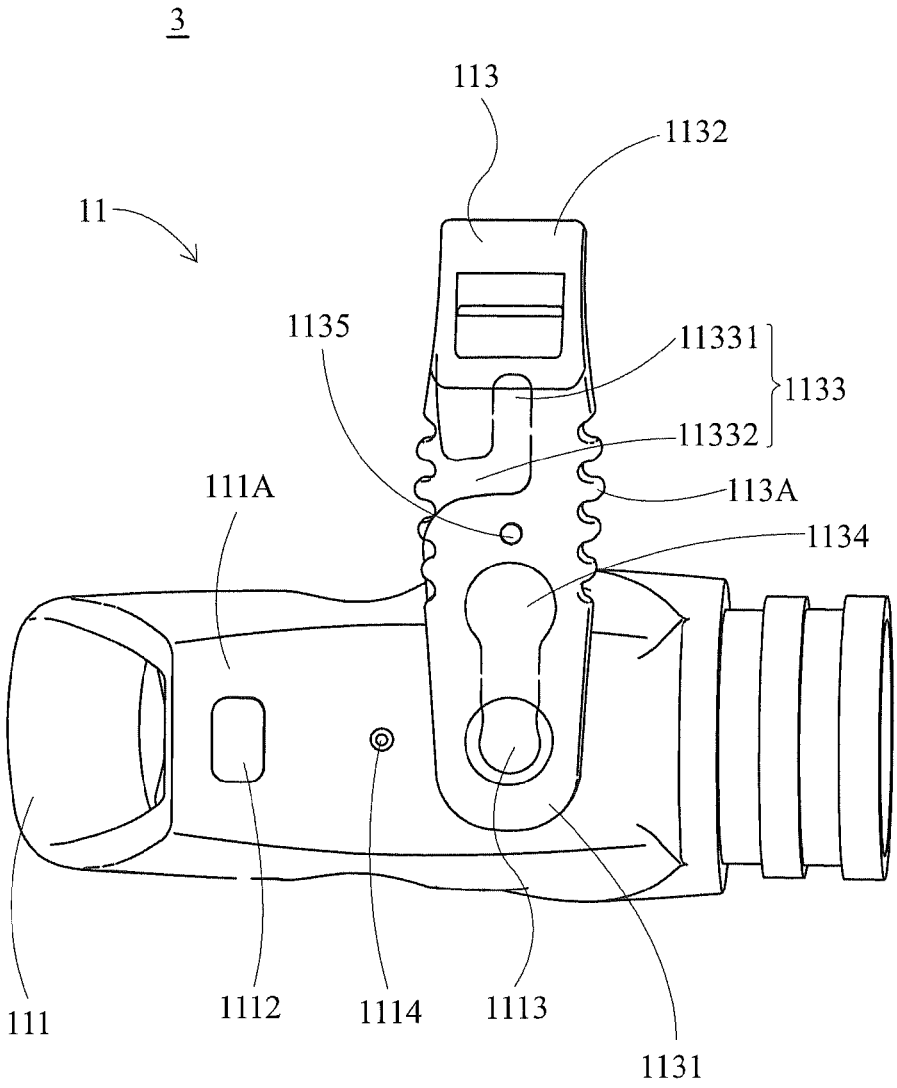

Referring to FIG. 5A to FIG. 5C, there are shown schematic plan views of the third preferred embodiment of the snorkel according to the present invention. The outer surface 113A of the whistle 113 has a first sliding slot 1133 and a second sliding slot 1134 disposed thereon. The first sliding slot 1133 further has a first portion 11331 and a second portion 11332 which communicate with each other. An extension direction of the first portion 11331 intersects with (and is approximately perpendicular to) an extension direction of the second portion 11332, and the extension direction of the first portion 11331 and an extension direction of the second sliding slot 1134 are substantially parallel to each other (they may be somewhat not parallel to each other due to manufacturing tolerances).

The outer surface 111A of the main body 111 has a position limiting bump 1112 and a cylinder 1113 disposed thereon. The position limiting bump 1112 is slidably and detachably connected to the first sliding slot 1133, and the cylinder 1113 is rotatably and slidably connected to the second sliding slot 1134. That is, the position limiting bump 1112 can slide in the first sliding slot 1133, and can be detached from the first sliding slot 1133 when sliding to an end of the second portion 11332; and the cylinder 1113 can slide in the second sliding slot 1134, and can rotate in the second sliding slot 1134 when the position limiting bump 1112 is in the second portion 11332.

When the whistle 113 is at the third position as shown in FIG. 5A, the position limiting bump 1112 is in the first portion 11331 of the first sliding slot 1133. The cylinder 1113 is at an end of the second sliding slot 1134. In this case, the whistle 113 is unable to rotate against the main body 111. When the whistle 113 slides to the first position as shown in FIG. 5B, the position limiting bump 1112 slides into the second portion 11332 and the cylinder 1113 slides to the other end of the second sliding slot 1134; and in this case, the whistle 113 can rotate against the main body 111. When the whistle 113 is rotated to the second position as shown in FIG. 5C, the position limiting bump 1112 is detached from the second portion 11332.

Additionally, to ensure that the whistle 113 will not slide against the main body 111 in normal conditions, the outer surface 113A of the whistle 113 may further be provided with a positioning groove 1135 and the outer surface 111A of the main body 111 may further be provided with a positioning bump 1114 which is detachably connected to the positioning groove 1135. The positioning groove 1135 may be a dome-shaped groove, while the positioning bump 1114 may be a dome-shaped bump.

When the whistle 113 is at the third position, the positioning bump 1114 is located in the positioning groove 1135. Because the positioning bump 1114 and the positioning groove 1135 interfere with each other, the whistle 113 cannot slide easily. If it is desired to slide the whistle 113, the user must firstly apply a great pushing force to detach the positioning bump 1114 from the positioning groove 1135. Then, when the whistle 113 is at the first position or the second position, the positioning bump 1114 is detached from the positioning groove 1135.

In reference to FIGS. 4A to 4C again, it shall be appreciated that when the whistle 113 is at the second position, the blowing portion 1132 of the whistle 113 and the mouthpiece 112 intersect with each other approximately perpendicularly; that is, if the mouthpiece 112 faces the user's mouth, then the blowing portion 1132 faces toward the top of the user's head. In case of a danger, the user can have the blowing portion 1132 face his mouth by simply rotating the mouthpiece assembly 11 slightly.

Furthermore, the outer surface 111A of the main body 111 of the snorkel 3 may also be provided with an accommodating groove 1111. When the whistle 113 is at the first position or the third position, the blowing portion 1132 is accommodated in the accommodating groove 1111.

According to the above descriptions, the snorkel of the present invention has the following features:

1. a smaller force is required from the user to rotate the whistle relative to the main body than that required to rotate the mouthpiece assembly relative to the tube;

2. the whistle can be accommodated in the accommodating groove of the main body, so other articles will not be easily hooked by the whistle; and 3. by means of the position limiting bump and the first sliding slot, the whistle will not rotate against the main body arbitrarily and can rotate only when being operated by the user; and 4. the whistle accommodated in the accommodating groove is subject less water resistance than conventional exposed one, so that, when user swims, the mouthpiece assembly will shake slightly or even no shake, which may decrease the user's jaw fatigue or injury.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A mouthpiece assembly of a snorkel, the mouthpiece assembly comprising:

a main body;

a mouthpiece, connecting to the main body; and a whistle, having a pivoting portion and a blowing portion opposite to the pivoting portion, and the pivoting portion pivotally connecting to the main body;

wherein the whistle is rotatable against the main body from a first position to a second position by the pivoting portion; and the blowing portion is closer to the main body when the whistle is at the first position than when the whistle is at the second position;

wherein the pivoting portion of the whistle is rotatably and slidably connected to the main body; the whistle is slidable against the main body from a third position to the first position by the pivoting portion.

2. The mouthpiece assembly of claim 1, wherein when the whistle is at the first position, the blowing portion abuts on an outer surface of the main body.

3. The mouthpiece assembly of claim 1, wherein an outer surface of the main body is provided with an accommodating groove, and when the whistle is at the first position, the blowing portion is accommodated within the accommodating groove.

4. The mouthpiece assembly of claim 3, wherein an outer surface of the whistle and the outer surface of the main body are both curved surfaces; when the whistle is at the first position, the outer surface of the whistle and the outer surface of the main body have a smooth transition therebetween.

5. The mouthpiece assembly of claim 1, wherein an outer surface of the main body is provided with an accommodating groove, and when the whistle is at the first position or the third position, the blowing portion is accommodated within the accommodating groove.

6. The mouthpiece assembly of claim 1, wherein an outer surface of the main body is provided with a position limiting bump and a cylinder, an outer surface of the whistle is provided with a first sliding slot and a second sliding slot, the position limiting bump is slidably and detachably connected to the first sliding slot, and the cylinder is rotatably and slidably connected to the second sliding slot;

wherein the first sliding slot has a first portion and a second portion communicating with the first portion, an extension direction of the first portion intersects with an extension direction of the second portion, and the extension direction of the first portion and an extension direction of the second sliding slot are substantially parallel to each other;

when the whistle is at the third position, the position limiting bump is within the first portion; when the whistle is at the first position, the position limiting bump is within the second portion; when the whistle is at the second position, the position limiting bump is detached from the second portion.

7. The mouthpiece assembly of claim 6, wherein the outer surface of the main body is provided with a positioning bump, the outer surface of the whistle is provided with a positioning groove, and the positioning bump is detachably connected to the positioning groove;

when the whistle is at the third position, the positioning bump is within the positioning groove; when the whistle is at the first position or the second position, the positioning bump is detached from the positioning groove.

8. The mouthpiece assembly of claim 1, wherein when the whistle is at the second position, the blowing portion of the whistle and the mouthpiece face toward the same direction.

9. A snorkel, comprising:

a the mouthpiece assembly of claim 1; and a tube, connecting to the main body, and communicating with the mouthpiece.

10. The snorkel of claim 9, wherein when the whistle is at the first position, the blowing portion abuts on an outer surface of the main body.

11. The snorkel of claim 9, wherein an outer surface of the main body is provided with an accommodating groove, and when the whistle is at the first position, the blowing portion is accommodated within the accommodating groove.

12. The snorkel of claim 11, wherein an outer surface of the whistle and the outer surface of the main body are both curved surfaces; when the whistle is at the first position, the outer surface of the whistle and the outer surface of the main body have a smooth transition therebetween.

13. The snorkel of claim 9, wherein an outer surface of the main body is provided with an accommodating groove, and when the whistle is at the first position or the third position, the blowing portion is accommodated within the accommodating groove.

14. The snorkel of claim 9, wherein an outer surface of the main body is provided with a position limiting bump and a cylinder, an outer surface of the whistle is provided with a first sliding slot and a second sliding slot, the position limiting bump is slidably and detachably connected to the first sliding slot, the cylinder is rotatably and slidably connected to the second sliding slot;

wherein the first sliding slot has a first portion and a second portion communicating with the first portion, an extension direction of the first portion intersects with an extension direction of the second portion, and the extension direction of the first portion and an extension direction of the second sliding slot are substantially parallel to each other;

when the whistle is at the third position, the position limiting bump is within the first portion; when the whistle is at the first position, the position limiting bump is within the second portion; when the whistle is at the second position, the position limiting bump is detached from the second portion.

15. The snorkel of claim 14, wherein the outer surface of the main body is provided with a positioning bump, the outer surface of the whistle is provided with a positioning groove, and the positioning bump is detachably connected to the positioning groove;

when the whistle is at the third position, the positioning bump is within the positioning groove; when the whistle is at the first position or the second position, the positioning bump is detached from the positioning groove.

16. The snorkel of claim 9, wherein when the whistle is at the second position, the blowing portion of the whistle and the mouthpiece face toward the same direction.

* * * * *